US010472102B2

(12) United States Patent
Laghi et al.

(10) Patent No.: US 10,472,102 B2
(45) Date of Patent: Nov. 12, 2019

(54) LOCKING DEVICE FOR A WHEELED LOAD

(71) Applicant: ROBOPAC S.P.A., Acquaviva-Gualdicciolo (SM)

(72) Inventors: Pierangelo Laghi, Ravenna (IT); Michele Terenzi, Fiorentino (SM)

(73) Assignee: ROBOPAC S.P.A., Acquaviva Gualdicciolo (SM)

( * ) Notice: Subject to any disclaimer, the term of this patent is extended or adjusted under 35 U.S.C. 154(b) by 361 days.

(21) Appl. No.: 15/526,510

(22) PCT Filed: Nov. 6, 2015

(86) PCT No.: PCT/IB2015/058590
§ 371 (c)(1),
(2) Date: May 12, 2017

(87) PCT Pub. No.: WO2016/075603
PCT Pub. Date: May 19, 2016

(65) Prior Publication Data

US 2017/0320602 A1 Nov. 9, 2017

(30) Foreign Application Priority Data

Nov. 12, 2014 (IT) ..... BO2014A0632

(51) Int. Cl.
*B65B 11/04* (2006.01)
*B65B 59/00* (2006.01)
(Continued)

(52) U.S. Cl.
CPC ..... *B65B 11/045* (2013.01); *B65B 11/025* (2013.01); *B65B 41/16* (2013.01);
(Continued)

(58) Field of Classification Search
CPC ..... B65B 11/045; B65B 11/025; B65B 41/16; B65B 59/005; B65D 2501/24987;
(Continued)

(56) References Cited

U.S. PATENT DOCUMENTS 1,168,719 A * 1/1916 French ..... A63H 19/30 193/35 R
2,674,466 A * 4/1954 Robb ..... B60P 7/13 188/32
(Continued)

FOREIGN PATENT DOCUMENTS

EP 0 450 732 10/1991
WO 2013/096263 6/2013

OTHER PUBLICATIONS

International Search Report dated Feb. 8, 2016 in corresponding International Application No. PCT/IB2015/058590.

*Primary Examiner* — Robert F Long
*Assistant Examiner* — Xavier A Madison
(74) *Attorney, Agent, or Firm* — Wenderoth, Lind & Ponack, L.L.P.

(57) ABSTRACT

A locking device associable to a wrapping machine for locking in a defined locked position a wheeled load to be wrapped with a plastics film, the locking device including a first element elongated along a first direction and arranged to rest on, and be fixed to, a supporting plane of the wrapping machine, and a second element connected to the first element. The second element is provided with a seat open on the supporting plane and includes an inlet opening for allowing a first wheel of the wheeled load be inserted into, or disengaged from, the seat along an insertion direction, and a recess arranged to be engaged by the first wheel in the locked position so as to prevent the first wheel from moving along the first direction and along a second direction, which
(Continued)

is substantially orthogonal to the first direction, and from disengaging from the seat.

14 Claims, 7 Drawing Sheets

(51) Int. Cl.
*B65B 41/16* (2006.01)
*B65B 11/02* (2006.01)

(52) U.S. Cl.
CPC ..... *B65B 59/00* (2013.01); *B65B 59/005* (2013.01); *B65B 2210/20* (2013.01); *B65D 2519/00781* (2013.01)

(58) Field of Classification Search
CPC ..... B65D 2519/00776; E01C 9/02; B21B 2203/28; B61K 7/16
USPC ..... 53/587; 410/67; 70/225; 280/179; 414/265
See application file for complete search history.

(56) References Cited

U.S. PATENT DOCUMENTS 3,084,953 A * 4/1963 McGregor ..... B60D 1/66 238/10 R
4,640,459 A * 2/1987 Hetemaa ..... E01C 9/02 238/122
6,524,040 B1 2/2003 Heil
8,641,027 B2 * 2/2014 Koskela ..... B65B 11/045 104/44

* cited by examiner

LOCKING DEVICE FOR A WHEELED LOAD

The invention relates to devices for locking in a defined position a wheeled load to be wrapped with a plastics film by means of a wrapping machine.

In the field of wrapping by means of film or sheet made of cold stretchable plastic material, it is known the need to wrap wheeled loads, such as carriages, frames, platforms, supports with wheels or similar holding products or objects, in an automatic manner by using wrapping machines, in particular of the type with rotating arm. In this type of wrapping machines, the load to be wrapped stands still at the center of the wrapping area while the unwinding unit, which comprises the film reel and the rotating rollers that unwind the film, is moved with respect to the load both in rotation around a vertical wrapping axis and in translation along the latter. In this way, the film is wrapped around the load so as to form a series of interlaced and/or superimposed bands or coils, thanks to the combination of a movement in the vertical direction of the unwinding unit and the relative rotation between the latter and the load.

In order to prevent during wrapping the wheeled load from moving as a consequence of the tractive action of film, suitable locking devices have to be provided for locking and fixing in the required operating position said wheeled load. The wheeled load generally comprises a carriage with a plan rectangular shape that is provided with four wheels, whose at least two on the same side are pivoting, i.e. rotatable around a respective vertical axis in order to allow moving and directing the load along a supporting plane or a surface. There are known locking devices comprising a rectilinear rail or guide that is provided with a longitudinal seat inside which two wheels of one side of the carriage can be inserted and can run. The rectilinear guide is fixed by means of screws and anchors to the supporting plane (floor) of the room or environment in which the wrapping machine is positioned. The rectilinear guide as engaged by two wheels of the carriage prevents transverse movements thereof. The guide comprises a mechanical stop or abutment, which can be manually engaged or disengaged and typically by means of a pedal, said mechanical stop rising after the passage of the front wheel of the carriage (the wheel that is firstly inserted into the guide), locking the front wheel against an end stop and thus preventing also longitudinal displacements of the carriage during wrapping.

A drawback of these locking devices lies in that the length of the rectilinear guide and positioning thereof near the wrapping machine depends on size of the wheeled load. More precisely, the length of rectilinear guide has to be such as to enable to receive both wheels of one side of the wheeled load. However, a high length of the locking guide can restrict the accessibility to the wrapping machine and/or can hinder movements of the loads around the wrapping machine, especially when the loads have small dimensions.

Therefore, rectilinear guides of different lengths have to be provided and selectively mounted aboard the machine in case carriages with evidently different dimensions have to be wrapped.

Since the position of the rectilinear guide must allow placing the carriage at the center of the wrapping area, it is then necessary to modify such position according to the dimensions (width or length) of the wheeled load.

In order to modify the position of rectilinear guide or in order to replace the latter with another guide of different length, it is however necessary to detach said guide from the supporting plane (by unscrewing anchor screws) and then ensure said guide, or replacement thereof, to other fixing points (holes for the anchors) to be provided on the supporting plan. These positioning and/or replacing operations require skilled operators and are long, laborious and expensive.

There are also known locking devices comprising a sheet metal plate or a slab that is provided with a hole or cavity suitable to receive and lock a pivoting wheel of the carriage. During the use, the carriage is pushed over the plate so as to insert the pivoting wheel in the cavity and thus prevent every movement to the carriage during wrapping.

However, these devices are not very effective and reliable for locking the wheel since the latter may come out of the plate cavity in an unexpected and undesired manner during wrapping due to the tractive force exerted by the film. In fact, the height or thickness of the plate is necessarily small for allowing an operator, at the end of wrapping, to push manually the wheel out of the cavity, i.e. to disengage the carriage from the locking device. Lifting the carriage is difficult, for example owing to the heavy weight, and can also destabilize and move the load.

All the above-described locking devices have the drawback of not allowing to wrap loads that are arranged on platform or supports (pallets) unprovided with wheels. In fact, the rectilinear guide, which extends within the wrapping area and the perforated plate, do not allow to firmly position loads without wheels within the wrapping area of the machine.

An object of the invention is to improve the known locking devices suitable to stop and lock in a defined position wheeled loads, such as carriages, frames, supports or platforms with wheels supporting products, to be wrapped with a film made of plastic material by means of a wrapping machine.

Another object is to achieve a versatile and flexible locking device that allows positioning and locking wheeled loads of any size and at the center of a wrapping area of the wrapping machine, so as to carry out an optimal wrapping of the load with the film.

A further object is to achieve a locking device having simple and economical construction. Still another object is to provide a locking device that allows wrapping also loads unprovided with wheels, such as platforms or pallets holding products or objects.

These and other further objects are achieved by a locking device according to one or more of the below claims.

The locking device of the invention is associable to a wrapping machine for stopping and locking in a defined locked position a wheeled load that has to be wrapped with a plastics film dispensed by the wrapping machine.

The device comprises a first element, which is elongated along a first direction and arranged to rest on, and be fixed to, a supporting plane of the wrapping machine and/or of the wheeled load and a second element that is arranged to rest on the supporting plane and is connected to the first element. The supporting plane comprises a supporting surface on which the wrapping machine, in particular of the type with rotating arm, rests and is fixed, or an upper surface of a rotatable platform or table of the wrapping machine that suitable to support and rotate the wheeled load around a wrapping axis.

The second element is provided with a seat that is open on the supporting plane and comprising an inlet opening and a recess. The inlet opening allows a first wheel of the wheeled load, which is rotatable on the supporting plane, to be inserted into, or disengaged from, said seat along an insertion direction that is transverse and inclined with respect to the first direction. The recess is arranged to be engaged by the first wheel in the locked position and is such as to prevent the first wheel from moving along the first direction and along a second direction that is substantially orthogonal to the first direction, and then from disengaging from the seat. The first element comprises a side wall arranged to be abutted by a second wheel of the wheeled load in the locked position, in particular while the wheeled load is wrapped by the wrapping machine with the film. The second element is connected to the side wall of the first element in a removable and adjustable manner in a position selectable along the first direction, according to dimensions of wheeled load.

Thanks to the locking device of the invention it is possible to stop and lock in a fast, simple and effective manner a wheeled load in a defined locked position by inserting a first wheel of the latter along the insertion direction into the seat of the second element of the device through the inlet opening and then lock the first wheel into the recess of the said seat, the second wheel abutting the side wall of the first element. The first and the second wheel of the load are preferably fixed wheels, i.e. wheels non-pivoting around a respective vertical axis. Therefore, the load is maintained locked during the wrapping phase by the tractive action of the film that is wrapped around the load by the winding machine.

The locking device of the invention allows locking in an effective and reliable manner wheeled loads of any dimension, the maximum overall dimensions of the latter ones being substantially defined by a wrapping area of the wrapping machine.

The length of first element defines, in fact, the maximum distance (wheelbase) between the wheels, i.e. the maximum width of the load that can be effectively locked, such length being chosen so that the maximum size of the load is the size admissible in the wrapping area.

The device further allows positioning and locking wheeled loads of any size at the center of the wrapping area of the wrapping machine for carrying out an optimal wrapping with the film. The second element, which has the locking seat for the load wheel, can be in fact easily and quickly mounted/dismounted on/from the first element, in particular cab be fixed in a mounting position suitable for the dimensions of the load.

The locking device of the invention further allows wrapping also loads unprovided with wheels, such as platforms or pallets supporting products or objects, since the second element can be moved or dismounted and removed so as not to encumber the wrapping area.

The invention can be better understood and carried out with reference to the attached drawings which illustrate an exemplary and non-limiting embodiment thereof, in which.

Figure 1:
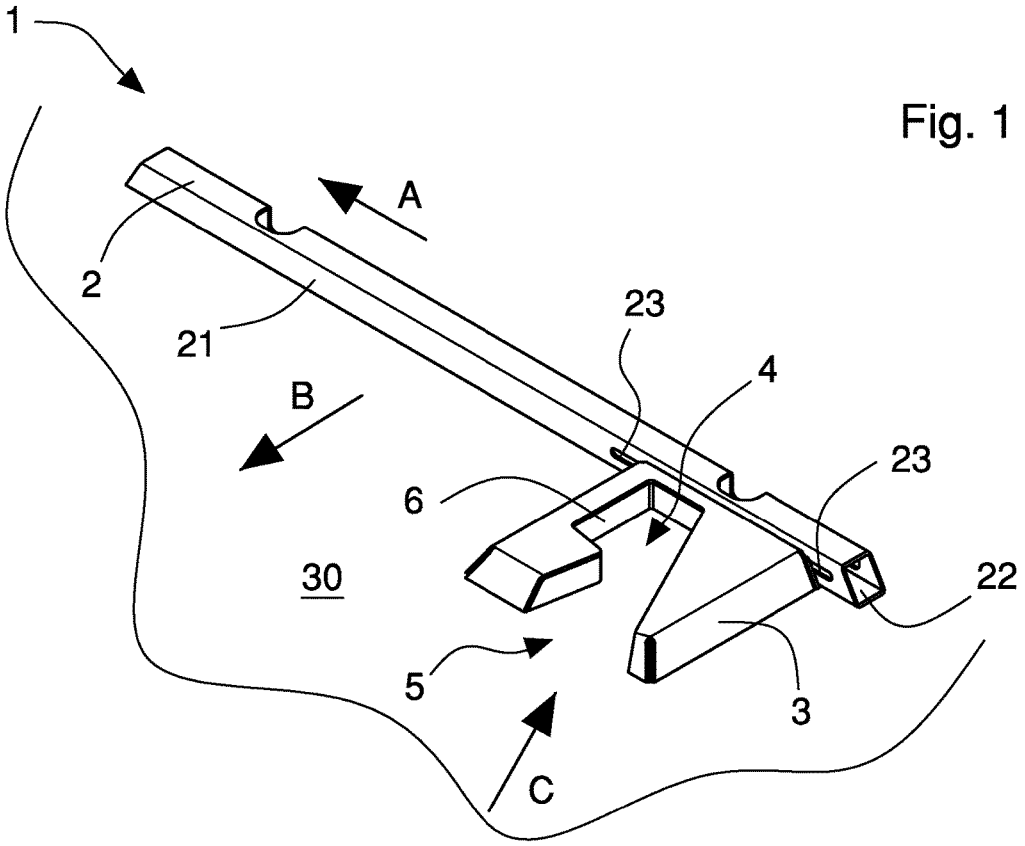
FIG. 1 is a perspective view of the locking device of the invention.
Figure 2:
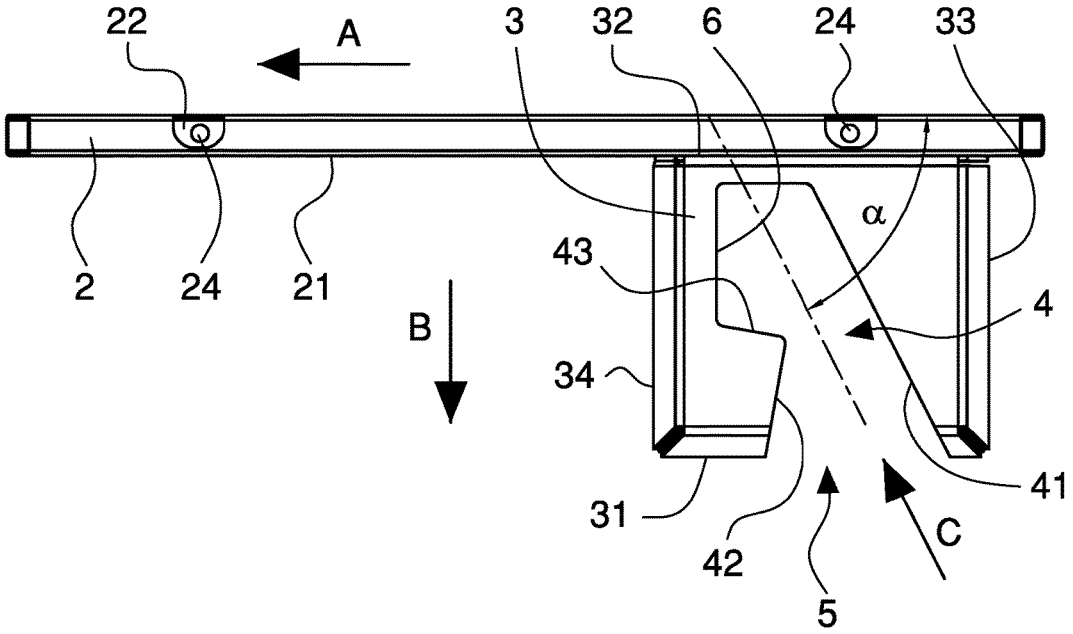
FIG. 2 is a plan view of the device of FIG. 1.

With reference to FIGS. 1 to 9, there is shown the locking device 1 of the invention that is associable to a wrapping machine 100, in particular of the type with rotating arm, which is arranged to wrap a wheeled load 50 with a film or sheet 60 made of cold stretchable plastic material. The wheeled load 50 comprises, for example, a carriage, a support or platform or container that is mounted on wheels and on which the products or objects are arranged. In the example of figures, the wheeled load comprises a carriage 50 having in plan view a rectangular shape and provided at the four corners of respective wheels, two of which are fixed wheels 51, 52 and two are pivoting wheels 53, 54, i.e. rotatable also around a vertical axis for enabling an operator to move and rotate the carriage 50.

The locking device 1 comprises a first element 2 that is elongated along a first direction A and arranged to rest on, and be fixed to, a supporting plane 30 of the wrapping machine 100 and/or of the wheeled load 50 and a second element 3 that is connected to the first element 2 and arranged to rest on the supporting plane 30.

The supporting plane 30 comprises a supporting surface, which supports and is fixed to the wrapping machine 100, in particular of the type with rotating arm as in the example illustrated in the figures, or can comprise an upper surface of a rotatable platform or table of the machine wrapping that is arranged to support and rotate the wheeled load around a wrapping axis.

The second element 3 is provided with a seat 4 open on the supporting plane 30 and comprising an inlet opening 5 and a recess 6. The inlet opening 5 allows a fixed first wheel 51 of the carriage 50, which rests and rotates on the supporting plane 30, to be inserted into, or disengaged from, the seat 4 along an insertion direction C that is transverse and inclined with respect to the first direction A along which the first element 2 extends. The recess 6 is arranged to be engaged by the first wheel 51 in a locked position L of the wheeled load 50 and is shaped so as to prevent the first wheel 51 from moving along the first direction A and along a second direction B, which is substantially orthogonal to the first direction A, and then from disengaging from the seat 4, in this manner constraining the carriage 50 to the locking device 1. The first direction A, the second direction B and the insertion direction C are horizontal and parallel to the supporting plane 30. The insertion direction C forms with the first direction A an angle $\alpha$ having a width comprised between 45° and 75°, in particular equal to about 60°.

The first element 2 comprises, for example, an elongated section bar, in particular a tubular section bar with rectangular section, provided with a side wall 21 to which the second element 3 is connected. Such side wall 21 is also arranged to be abutted by a fixed second wheel 52 of the carriage 50 in the locked position L, in particular while the carriage 50 is wrapped and wound with the film 60 by the wrapping machine 100 in an operating wrapping phase.

The first wheel 51 and second wheel 52 are, for example, the fixed front wheels of the carriage 50.

The second element 3 comprises a plate having in plan view an almost rectangular shape, for example a square shape, and internally provided with the seat 4. The plate 3, for example made by bending a metal sheet, has four sides. A first side 31 of plate 3 comprises the inlet opening 5 of the seat 4, a second side 32, which is opposite to the first side 31, is in abutment with the side wall 21 of the first element 2 for fixing thereto the second element 3. The first side 31 and second side 32 are parallel to the side wall 21 of the first element 2 and to the first direction A. A third side 33 and fourth side 34 of the plate 3, which are mutually opposed and parallel, are interposed between the first side 31 and the second side 32 and substantially orthogonal to the latter ones. The height or the thickness of the said sides 31, 32, 33, 34 from the supporting plane 30 is such as to avoid, in the inserting phase, that the wheel 51 may unintentionally climb on the second element 3, externally to the seat 4 or exit from the seat 4 during wrapping phase.

The seat 4 comprises a first inclined wall 41, which is parallel to the insertion direction C, and a second inclined wall 42, which is opposite to the first inclined wall 41 and converging towards the latter. The inclined walls 41, 42 form the inlet opening 5 having shape converging towards the recess 6 along the insertion direction C so as to facilitate insertion of the first wheel 51 in an inserting phase of the carriage 50 and disengagement of the wheel 51 in a disengaging phase, as better explained in the following description.

The recess 6 comprises a third abutment wall 43, which is transverse to the second direction B and engaged by the first wheel 51 in the locked position L. The third wall 43 is slightly inclined towards the first side 31 of the second element 3, for example so as to form an angle of about 10° with the first direction A in order to facilitate disengagement of the first wheel 51. The recess 6 has in plan view an almost rectangular shape and dimensions such as to contain, with small play, the first wheel 51 of carriage 50.

The second element 3 is connected to the side wall 21 of the first element 2 so that the inlet opening 5, i.e. the first side 31, is substantially parallel to the said side wall 21.

The second element 3 is also connected to the side wall 21 of the first element 2 in a removable and adjustable manner, i.e. it can be fixed in a position selectable along the first direction A, in particular according to a size of carriage 50. For such purpose, fixing means is provided for connecting and disconnecting in a quick and easy manner the second element 3 to the side wall 21. In the illustrated embodiment, the fixing means comprises a plurality of through slots 23, which are mutually spaced apart and carried out on the side wall 21, and screws or similar that are connected to the second element 3 and arranged to engage said slots 23. The slots 23 allow fixing the second element 3 to the first element 2 in a plurality of different positions along the side wall 21.

The first element 2 also comprises a base wall 22 that rests on the supporting plane 30 and has a couple of holes 24 for fixing the first element 2 (for example by means of screws and anchors) and thus the locking device 1 to said supporting plane 30 in a defined mounting position.

Figure 3:
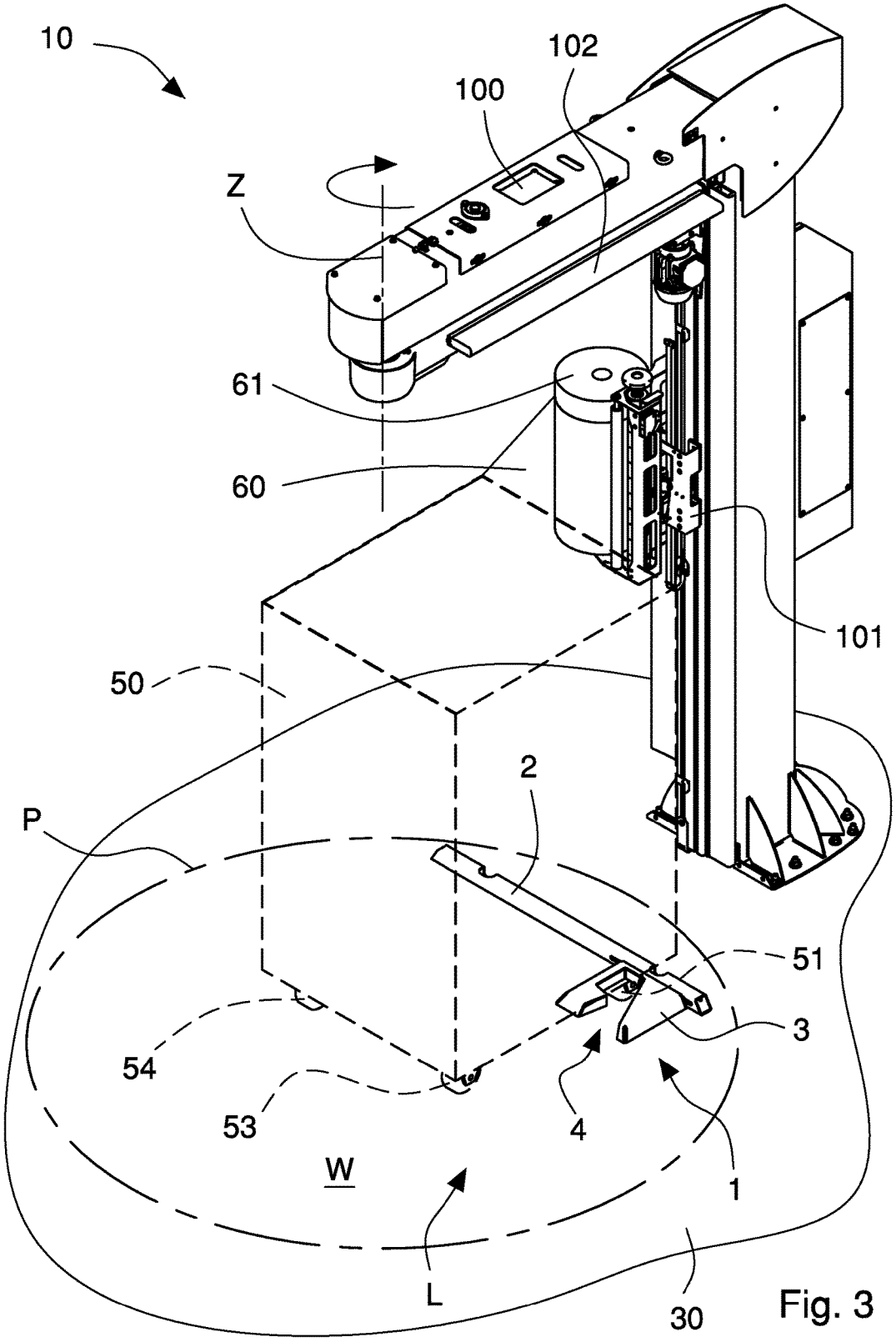
FIG. 3 is a perspective view of the locking device of FIG. 1 that is associated to a wrapping machine with rotating arm and to a wheeled load to be wrapped, shown with a broken line and in a locking position.
Figure 6:
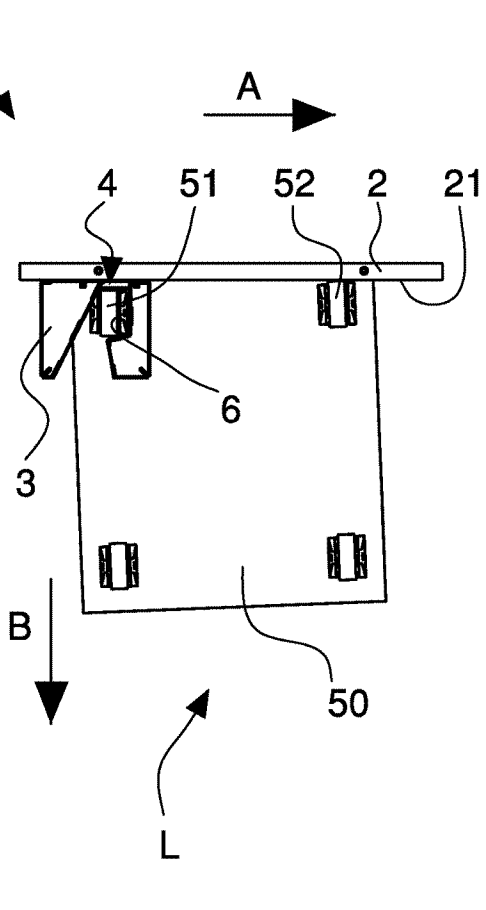
FIGS. 4 to 6 are bottom plan views of the locking device of FIG. 1 and of the wheeled load in three respective positions of an inserting and locking sequence.

As illustrated in detail in FIG. 3, the locking device 1 is fixed to the supporting plane 30 in a mounting position in which it is adjacent to the wrapping machine 100 and allows to position and lock the carriage 50 within a wrapping area W of the wrapping machine 100.

The wrapping area W is substantially defined by a circular trajectory P of the unwinding unit 101 of the wrapping machine 100 that is mounted vertically slidable along a rotating arm 102 of the latter. The rotating arm 102 rotates around a vertical wrapping axis Z. The unwinding unit 101, of known type, comprises a reel 61 of film 60 and a plurality of pre-stretching and return rollers for unwinding and pre-stretching the film 60.

The wrapping machine 100 and the locking device 1 of the invention that is associated thereto form a wrapping system 10 suitable to wrap a wheeled load 50, for example a carriage, with a film 60 made of stretchable plastic material.

The operation of the locking device 1 of the invention provides an inserting and locking phase of the wheeled load or carriage 50 on the locking device 1.

Figure 5:
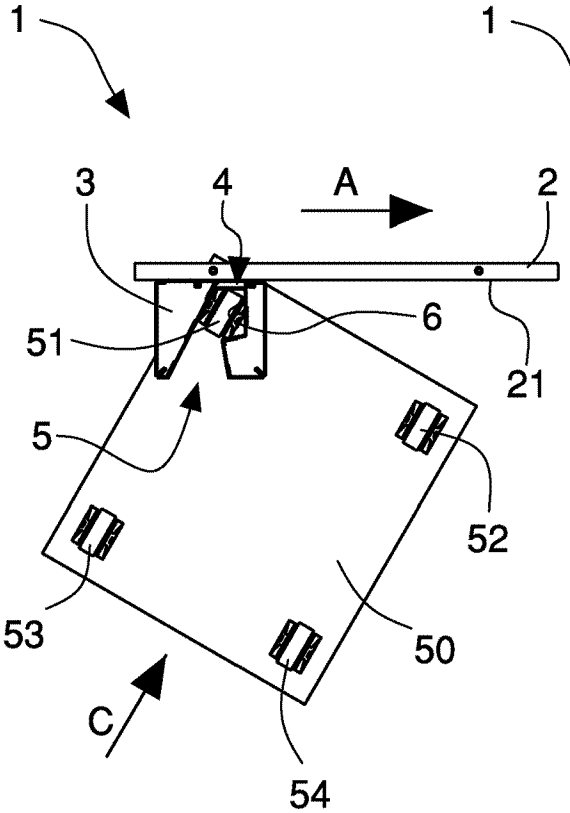
Figure 4:
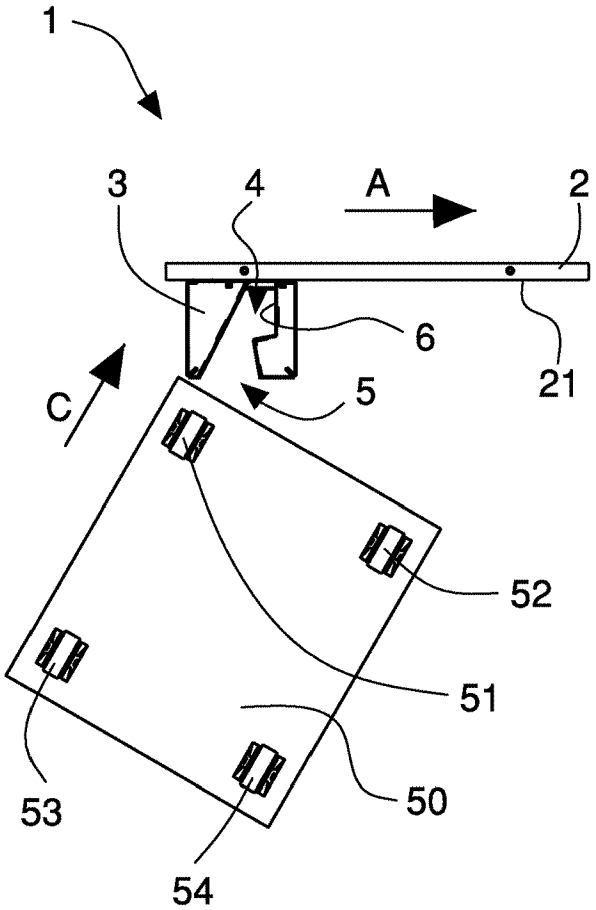

The carriage 50 is manually pushed by an operator along the insertion direction C (FIG. 4) so that the fixed first wheel 51 of the carriage 50 can be inserted into the seat 4 of second element 3. More precisely, the fixed first wheel 51 is introduced, rolling on the supporting plane 30 along the insertion direction C through the inlet opening 5 until is partially placed in the recess 6 (FIG. 5). At this point, the carriage 50 is rotated—thanks to a third pivoting wheel 53 and a fourth pivoting wheel 54 that are both rear wheels and opposite to the fixed wheels 51, 52—so as to push the fixed first wheel 51 completely inside the recess 6 and the fixed second wheel 52 against the side wall 21 of first element 2 (FIG. 6) in the locked position L.

In the operating wrapping phase, the wrapping machine 100 wraps the wheeled load or carriage 50 with the film 60 so as to maintain the couple of front fixed wheels 51, 52 engaged with the locking device 1 in the locked position L.

More precisely, in the operating wrapping phase, while the first wheel 51 is engaged and locked in the seat 4 of the second element 3 of the locking device 1, the second wheel 52 is maintained in abutment with the side wall 21 of the first element 2 of the locking device 1, since the carriage 50 is subject to a torque or rotating moment t is caused by the tractive action or traction of wrapping film 60. More precisely, as illustrated in FIG. 7, the film 60 that is wrapped around the wrapping axis Z in a clockwise direction in the illustrated example, exerts on the load 50 a tractive tangential force, which tends to substantially rotate the carriage 50 around the wrapping axis Z in the same direction (clockwise).

Nevertheless, this rotation of the carriage 50 is prevented by the fixed wheels 51, 52, which are in contact and maintained in abutment with the walls of recess 6 of seat 4 of the second element 3 and with the side wall 21 of first element 2. The tractive action of the film 60 maintains the load 50 perfectly locked in the locked position L during the whole wrapping phase, movements along the first direction A being prevented by the first wheel 51 engaged in the seat 4.

It should be noted that the maximum overall dimensions of wheeled load 50 lockable by the device 1 of the invention are substantially defined by the wrapping area W of the wrapping machine 100, which depends on structure and dimensions thereof. In fact, the load 50 is locked to the device 1 by means of the fixed front wheels 51, 52 of said load 50, the first wheel 51 being engaged in the seat 4 of the second element 3 (fixed to the side wall 21 of the first element 2) and the second wheel 52 being in abutment with the same side wall 21. The length of the first element 2 then defines the maximum distance (wheelbase) between said wheels 51, 52, i.e. the maximum width of the load 50 that can be effectively locked. This length can be selected in such a manner that the maximum size of the load 50 is the maximum size allowable in the wrapping area W.

Figure 7:
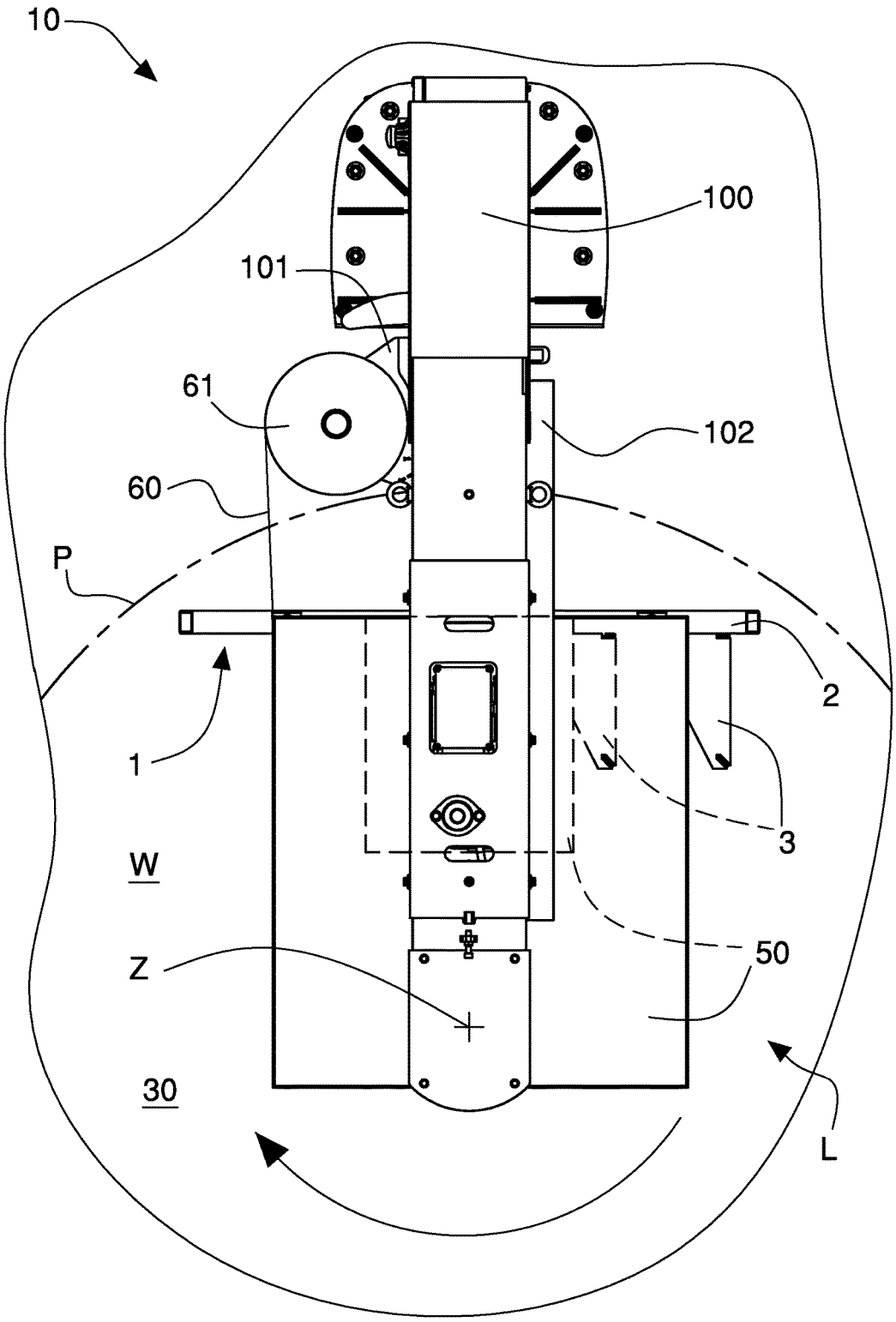
FIG. 7 is a top plan view of device, wrapping machine and wheeled load in a wrapping phase, wherein with broken line is shown another wheeled load of smaller dimensions.
Figure 9:
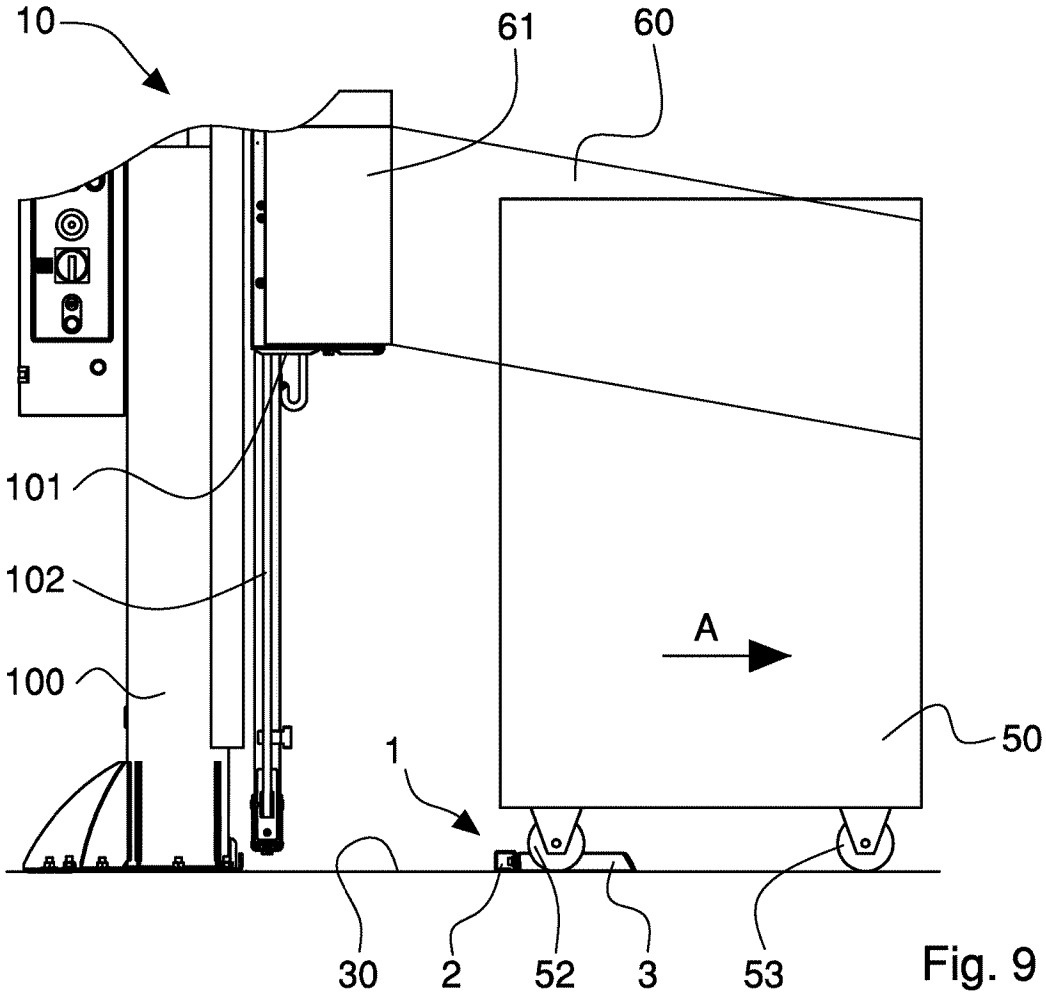
FIG. 9 is a side view of device, wrapping machine and wheeled load of FIG. 7.
Figure 8:
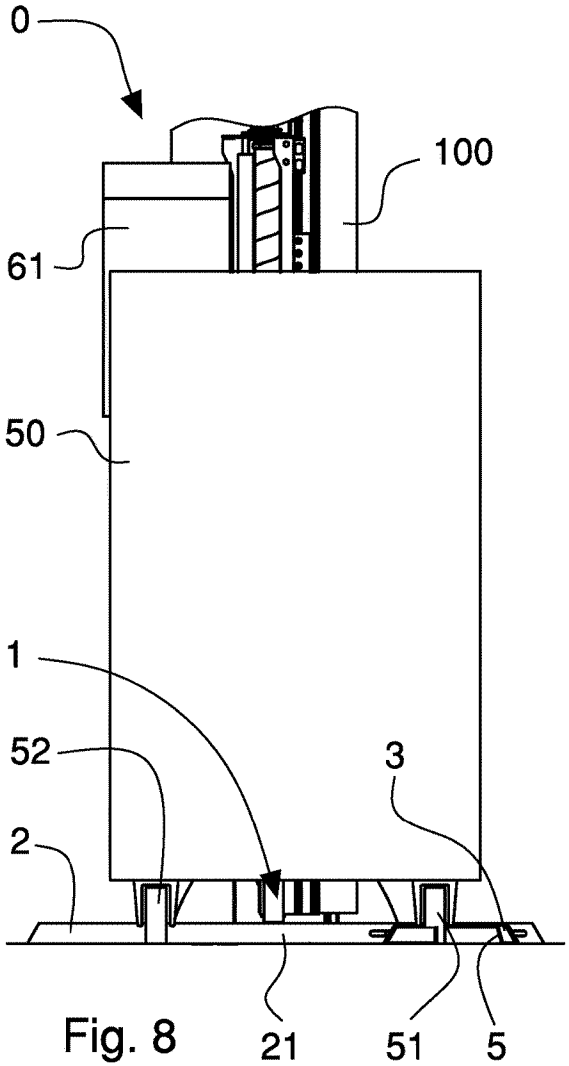
FIG. 8 is a front view of device, wrapping machine and wheeled load of FIG. 7.

As illustrated in FIG. 7 with broken line, in case the load 50 has smaller and reduced dimensions, in order to maintain said load 50 substantially at the center of the wrapping area W for an optimal wrapping of said load with the film 60, it is possible to reposition the second element 3 along the side wall 21 of the first element 2. Thanks to the fixing means, the second element 3 can be easily and rapidly mounted/dismounted on/from the first element 2, in particular it can be fixed in a mounting position suitable for the dimensions of load 50.

Finally, it should be noted that the first element 2 fixed to the supporting plane 30 does not prevent from wrapping with the film 60 loads unprovided with wheels, arranged for example on a platform or pallet. The first element 2 does not encumber, if not peripherally and partially and, the wrapping area W and may even act as abutment or reference element for correctly positioning the pallet. For this purpose and according to the dimensions of the load to be wrapped, the second element 3 eventually can be moved along the side wall 21 of the first element 2 or dismounted and removed.

Thus, thanks to the locking device 1 of the invention it is possible in a fast, simple and effective manner to stop and lock in a defined locked position a wheeled load 50 to be wrapped with a plastic film 60 by means of a wrapping machine 100.

The device 1 further allows locking in efficient and reliable manner wheeled loads 50 of any size, the maximum overall dimensions of the latter ones being substantially defined by the wrapping area W of the wrapping machine 100. The device 1 is particularly versatile and flexible since it allows positioning and locking the loads at the center of wrapping area W of the wrapping machine for carrying out an optimal wrapping with the film. The second element 3, provided with the seat 4 for locking the fixed first wheel 51 of load 50, can be positioned in adjustable manner along the first element 2.

The locking device 1 of the invention also allows wrapping loads unprovided with wheels, such as platforms or pallets supporting products or objects. In fact, the first element 2 does not encumber the wrapping area W and can act as abutment or reference element for correctly positioning the load. According to dimensions of the load, the second element 3 can be moved eventually along the side wall 21 of the first element 2 or dismounted and removed.

The locking device 1, which comprises a first element 2 constituted by an elongated tubular section bar and a second element 3 substantially constituted by a plate made of bent sheet metal, has simple and economical construction.

Figure 11:
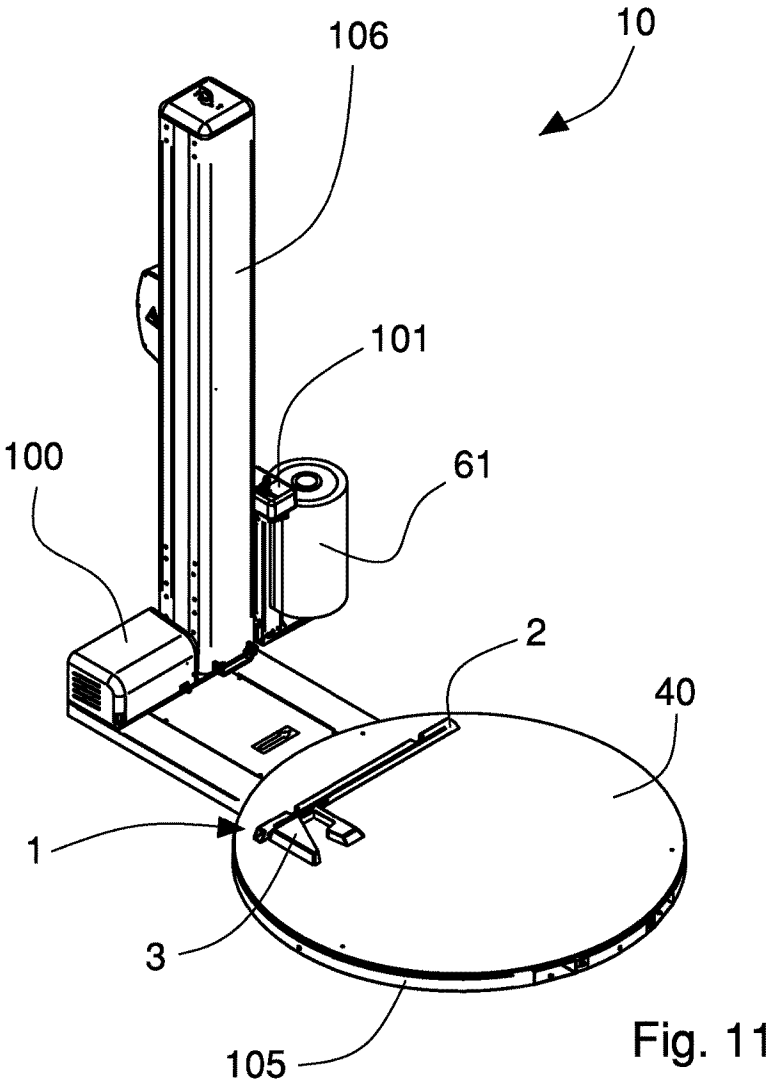
FIG. 11 is a perspective view of locking device and wrapping machine of FIG. 10.
Figure 10:
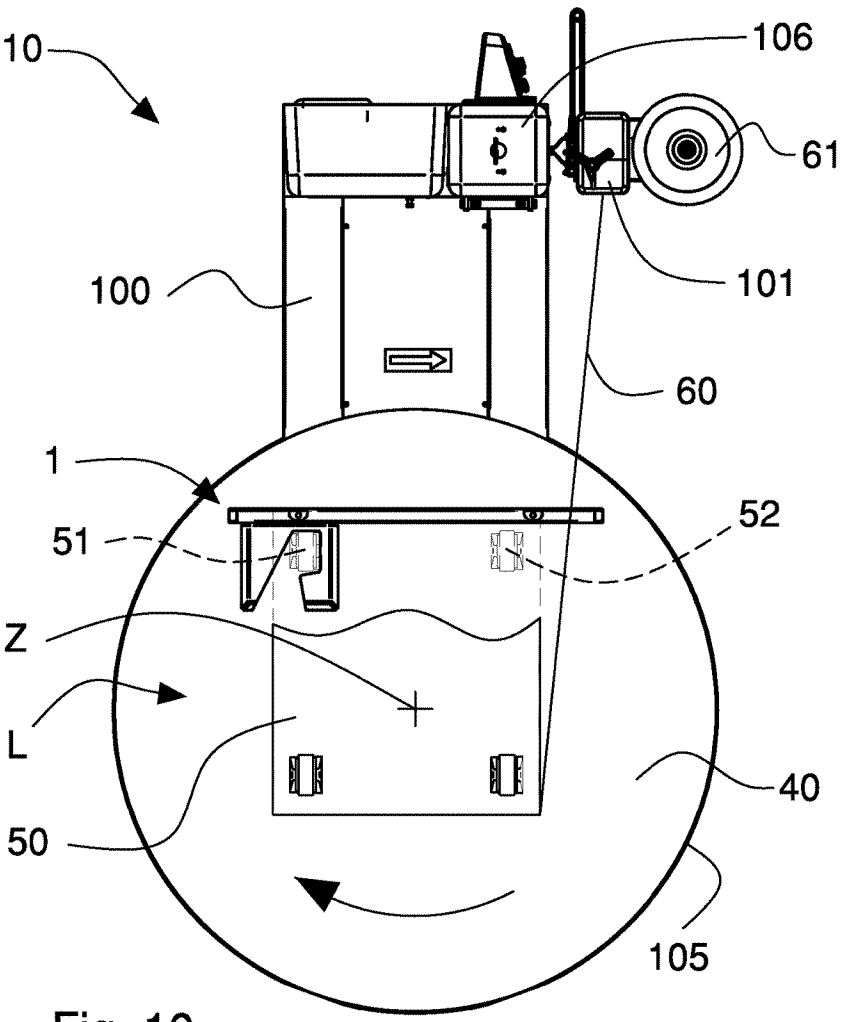
FIG. 10 is a top plan view of the locking device of the invention that is fixed to a rotatable platform of a wrapping machine and associated to a load and illustrated in a locking position.

With reference to FIGS. 10 and 11, the locking device 1 of the invention can be associated to a wrapping machine 100 of the type with rotatable platform or table in which the wheeled load 50 is supported and rotated around a vertical wrapping axis Z and the unwinding unit 101 is linearly and vertically mobile along a fixed column 106 of the wrapping machine 100.

More precisely, the locking device 1 is fixed, for example screwed, to a supporting plane comprising, in this case, an upper surface 40 of a rotatable platform 105 of the wrapping machine 100, so as to lock the wheeled load or carriage 50 positioned thereon.

The rotatable platform 105 rotates around the wrapping axis Z, in a clockwise direction in the illustrated example, in such a manner that the film 60, unwound from the reel 61 positioned on the unwinding unit 101, exerts on the carriage 50 a tangential tractive force that tends to rotate the carriage 50 in the opposite direction so as to maintain the fixed wheels 51, 52 of the carriage 50 in abutment with the seat 4 of second element 3 and with the side wall 21 of first element 2. The tractive action of film 60 maintains the load 50 perfectly locked in the locked position L on the rotatable platform 105 during the whole wrapping phase.

Figure 12:
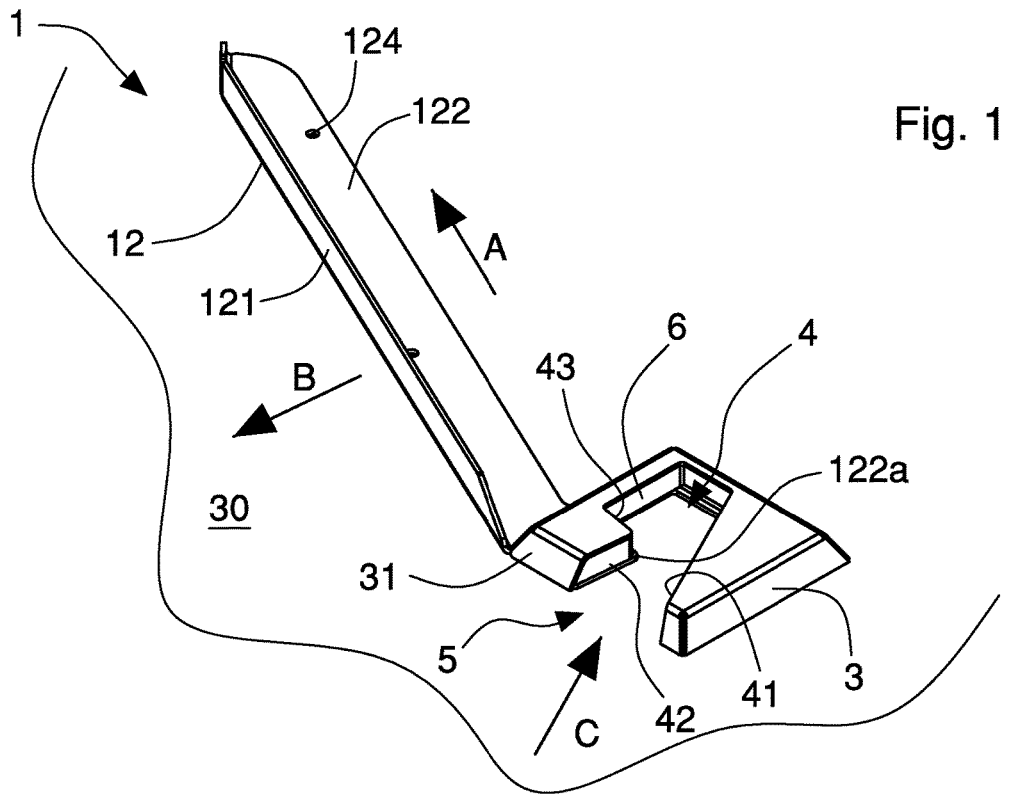
FIG. 12 is a perspective view of a variant of the locking device of the invention.
Figure 13:
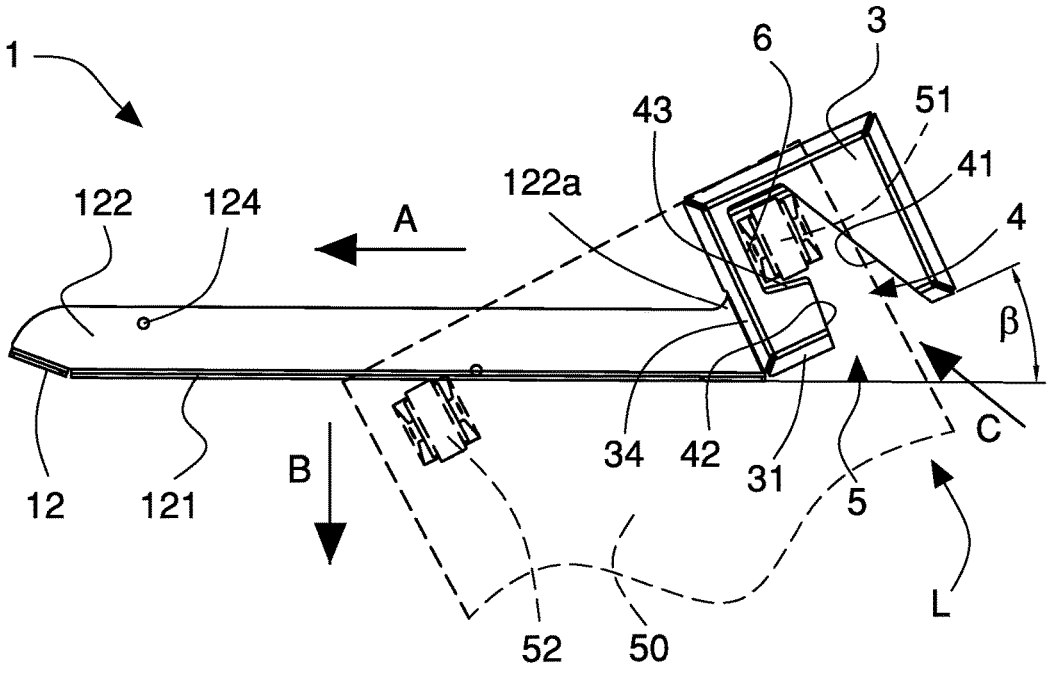
FIG. 13 is a top plan view of the variant of the device of FIG. 12 that is associated with a wheeled load to be wrapped, shown partially and with broken line in a locking position.

FIGS. 12 and 13 illustrate a variant of the locking device 1 of the invention that differs from the embodiment above described and illustrated in FIGS. 1 to 9 for the first element 12 that comprises an elongated section bar, for example metal section bar, having a "L" open section that is provided with a flat side wall 121 and a flat base wall 122, which form an angle of about 90°. The side wall 121 is arranged to be abutted by one of the fixed wheels 51, 52 of the carriage 50 (for example the fixed second wheel 52) in the locked position L, the remaining fixed wheel (for example the first wheel 51) being housed in the recess 6 of the seat 4.

The base wall 122 rests on the supporting plane 30 and has a couple of holes 124 for fixing the first element 12 (for example by means of screws and anchors) and the locking device 1 to said supporting plane 30 in a defined mounting position.

The second element 3, which is substantially identical to the one of the above disclosed embodiment, comprises a plate, having in plan view a substantial rectangular shape, internally provided with the seat 4 and fixed to the base wall 122 so that the inlet opening 5, i.e. the first side 31 of the second element 3, is inclined with respect to the side wall 121 by a fixing angle β for example comprised between 15° and 45°, in particular equal to 25°, and however such as to allow freely positioning a load unprovided with wheels against the side wall 121, as better explained in the following description.

In the variant shown in the figures, the base wall 122 comprises in particular a connecting portion 122*a* on which the second element 3 is fixed. Such connecting portion 122*a* has in plan view the same shape, comprising the seat 4, of second element 3. In such a manner, the second element 3 rests on the supporting plane 30 by means of connecting portion 122*a*.

There is also provided that second element 3 rests directly on the supporting plane 30 and is fixed to the base wall 122 at the fourth side 34.

This variant of the locking device 1 of the invention allows to easily lock loads also unprovided with wheels, arranged for example on a platform or a pallet.

In fact, the second element 3 is fixed to the first element 12 inclined at the fixing angle β, in such a manner to not interfere and not hinder the positioning of the load on pallet resting on the supporting plane 30 and in abutment with the side wall 121. In particular, the load can slide freely on the side wall 121 along the first direction A without being hindered by the second element 3.

Therefore, without using tools and/or moving parts (especially without dismounting the second element 3) it is possible to package any product both on wheels and without wheels.

The invention claimed is:

1. A locking device associable to a wrapping machine for locking in a defined locked position a wheeled load to be wrapped with a plastics film dispensed by the wrapping machine, the locking device comprising:

a first element that is elongated along a first direction and arranged to rest on, and be fixed to, a supporting plane of the wrapping machine and/or of the wheeled load; and a second element that is arranged to rest on the supporting plane and connected to said first element, wherein said second element is provided with a seat open on the supporting plane and comprises an inlet opening to allow a first wheel of the wheeled load, rotatable on the supporting plane, to be inserted in, or disengaged from, said seat along an insertion direction that is transverse and inclined with respect to the first direction, and with a recess arranged to be engaged by the first wheel in the locked position so as to prevent the first wheel from moving at least along the first direction and along a second direction substantially orthogonal to the first direction and from disengaging from said seat.

2. The locking device according to claim 1, wherein said first element comprises a side wall arranged to be abutted by a second wheel of the wheeled load in the locked position.

3. The locking device according to claim 1, wherein said second element is connected to a side wall of said first element in a removable and adjustable manner and in a selectable position along the first direction.

4. The locking device according to claim 1, wherein said first element comprises an elongated tubular section bar and said second element comprises a plate that is provided with said seat.

5. The locking device according to claim 2, wherein said first element comprises a base wall which rests on the supporting plane and is connected to said side wall, and said second element is connected to said base wall.

6. The locking device according to claim 5, wherein said second element is connected to said base wall in such a manner that said inlet opening is inclined with respect to said side wall.

7. The locking device according to claim 5, wherein said first element comprises an elongated section bar that has a "L" shape and said second element comprises a plate provided with said seat, which is fixed to a connecting portion of said base wall.

8. The locking device according to claim 1, wherein said seat comprises a first inclined wall parallel to the insertion direction and a second inclined wall opposite to said first inclined wall, and said first and second inclined walls form said inlet opening converging towards said recess along the insertion direction.

9. The locking device according to claim 8, wherein said recess comprises a third abutment wall that is transverse to the second direction and engaged by said first wheel in the locked position.

10. The locking device according to claim 1, wherein said recess has dimensions such as to receive with small play the first wheel in the locked position.

11. A wrapping system for a wheeled load, the wrapping system comprising:

a wrapping machine; and a locking device fixed to a supporting plane of said wrapping machine and/or of the wheeled load, wherein the locking device is able to lock in a defined locked position the wheeled load to be wrapped with a plastics film dispensed by said wrapping machine, wherein said locking device comprises:

a first element that is elongated along a first direction and arranged to rest on, and be fixed to, the supporting plane of said wrapping machine and/or of the wheeled load; and a second element that is arranged to rest on the supporting plane and connected to said first element, and wherein said second element is provided with a seat open on the supporting plane and comprises an inlet opening to allow a first wheel of the wheeled load, rotatable on the supporting plane, to be inserted in, or disengaged from, said seat along an insertion direction that is transverse and inclined with respect to the first direction, and with a recess arranged to be engaged by the first wheel in the locked position so as to prevent the first wheel from moving at least along the first direction and along a second direction substantially orthogonal to the first direction and from disengaging from said seat.

12. The wrapping system according to claim 11, wherein the supporting plane includes a supporting surface that supports said wrapping machine and said locking device is fixed to the supporting surface in a mounting position in which said locking device is adjacent to said wrapping machine and allows to position and lock the wheeled load within a wrapping area of said wrapping machine.

13. The wrapping system according to claim 11, wherein the supporting plane includes an upper surface of a rotatable platform of said wrapping machine, the rotatable platform being arranged to support and rotate around a wrapping axis the wheeled load.

14. The wrapping system according to claim 11, wherein said wrapping machine wraps the wheeled load with a plastic film so as to push at least two wheels of the wheeled load against said locking device, a first wheel of the at least two wheels being engaged and locked in a seat of said locking device in a locked position.

* * * * *